United States Patent [19]

Barker

[11] Patent Number: 5,060,352

[45] Date of Patent: Oct. 29, 1991

[54] MANUFACTURE OF EXPANDED SHEET METAL ARTICLES

[76] Inventor: Victor G. Barker, Whinfell, Black Range Road, Romsey, Victoria, 3434, Australia

[21] Appl. No.: 555,191

[22] Filed: Jul. 18, 1990

Related U.S. Application Data

[63] Continuation-in-part of Ser. No. 407,902, Sep. 15, 1989, abandoned.

[30] Foreign Application Priority Data

Sep. 29, 1988 [AU] Australia ..... PJ0672

[51] Int. Cl.[5] ..... B21D 31/04

[52] U.S. Cl. ..... 29/6.1; 428/596

[58] Field of Search ..... 29/6.1, 6.2, 412; 428/596, 597, 595

[56] References Cited

U.S. PATENT DOCUMENTS

| | | | |
|---|---|---|---|
| 1,195,221 | 8/1916 | Herr | 29/6.1 |
| 3,111,204 | 9/1963 | Phare | 29/6.1 X |
| 3,740,812 | 6/1973 | Ryan | 29/6.1 |
| 3,812,558 | 5/1974 | Watanabe | 29/6.1 |
| 3,962,763 | 6/1976 | Jury | 29/6.1 |
| 4,545,170 | 10/1985 | Shirey | 29/6.1 X |

*Primary Examiner*—Joseph M. Gorski
*Assistant Examiner*—S. Thomas Hughes
*Attorney, Agent, or Firm*—Lockwood, Alex, FitzGibbon & Cummings

[57] ABSTRACT

A method of making an expanded sheet metal article comprising the steps of forming a workpiece of lesser area than that of the article, slitting the area of the workpiece to form a plurality of tongues extending longitudinally and at an angle to the longitudinal in a non-functional zone of the article to render the non-functional zone extendable, shaping the remainder of the workpiece as needed to form the article, and extending the non-functional zone to produce the final article.

8 Claims, 3 Drawing Sheets

FIG. 4.
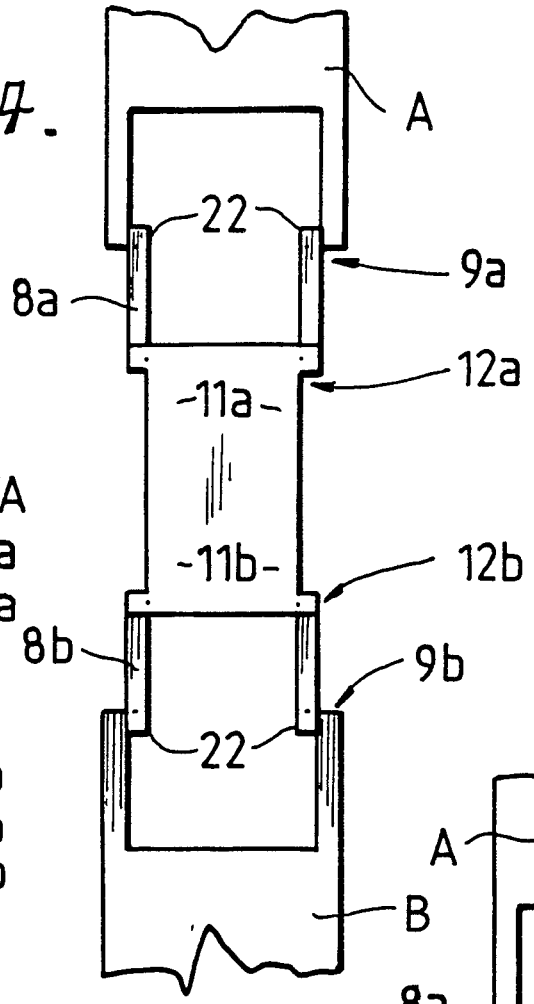
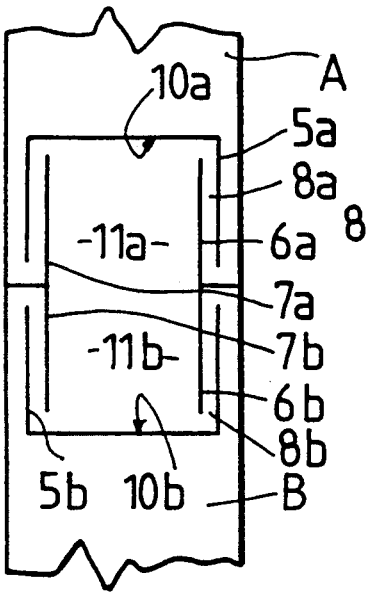
FIG. 3.
FIG. 6.
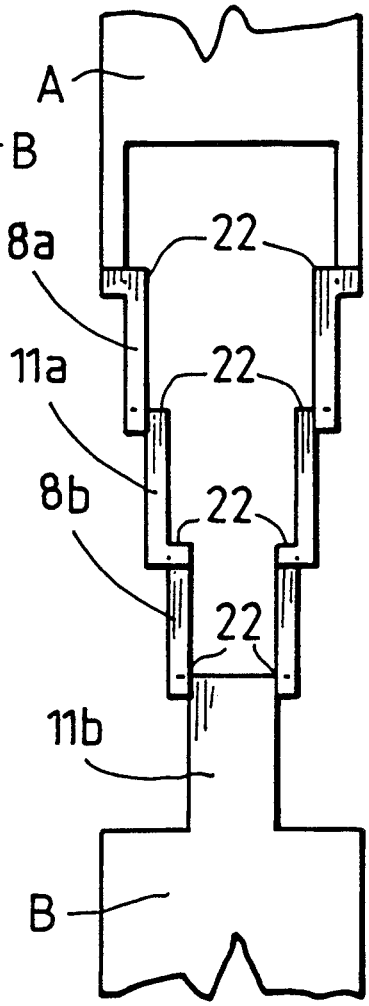
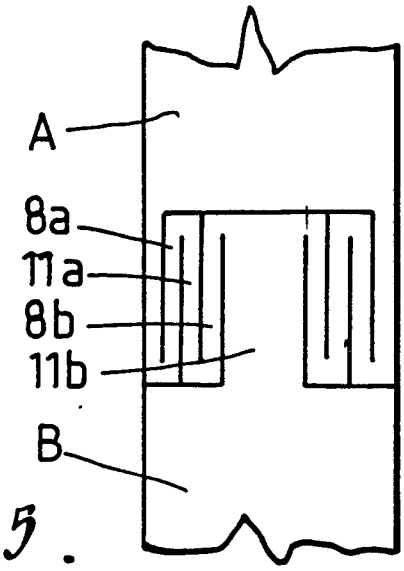
FIG. 5.

MANUFACTURE OF EXPANDED SHEET METAL ARTICLES

RELATED APPLICATION

The present application is a continuation-in-part of application Ser. No. 407,902, filed Sep. 15, 1989, abandoned.

This invention relates to the manufacture of sheet metal articles and refers particularly, though not exclusively, to the manufacture of expanded sheet metal articles.

It frequently happens when two sheet metal components are required in a composite structure that it is convenient to combine the two components into a single article so that both may be made simultaneously by a single stamping and/or pressing operation. Thus the respective components become functional zones of a single article spaced apart as needed in the composite structure by an intermediate, inherently functionless zone. Hitherto, for simplicity of manufacture of such articles, it has been commonplace to utilize a workpiece big enough to extend from one functional zone to the other, and to tolerate the wastage of material implicit in having in the finished article a sheet or strip of the metal integral with the functional zones and extending from one to the other.

A typical workpiece of the kind in question is a fixing clip used for the secret fixing of sheet metal roofing profile sheets. One well-known roofing sheet manufactured and sold under the trade mark "KLIP-LOK" comprises a sheet of coated steel having three substantially channel-sectioned ribs extending for the length of the sheet. There is one rib at each edge and an intermediate rib substantially coinciding with the centre line of the sheet.

Those roofing sheets are secured to purlins or the like by strip-shaped clips, which have, at each end, formations adapted to snap-engage, or be snap-engaged by, the ribs of the roofing sheet. The arrangement is such that a clip may be applied with one end formation fitting over an edge rib of a previously laid sheet and extending to a point where its other end formation may engage within the central rib of the next-applied sheet. The clip may be secured to the supporting timbers for the roof deck by nails or the like through affixture holes near each end of the clip, and the next sheet applied so that an edge and the central rib snaps over the respective end formations of the clip. Thus, once the clip has been applied to the purlin, the material intermediate the end formations ceases to serve any functional purpose; its initial presence being purely to assist in the manufacture of the clip, to ensure that the functional ends thereof are correctly spaced apart, and to facilitate the handling of the clip and its installation by the person laying the roof.

The present invention was devised primarily for the manufacture of such clips. As the width of the secret-fix roofing profiles have increased, the operative length of the clips has increased. This has meant an increase in the amount of material used in the manufacture of the clips. As the functional purpose of the clip is achieved by the end formations and the material intermediate the end formations serves only to space apart the end formations and has no significant structural strength requirements, this increase in material has occurred in those parts of the clip not serving the principal functional purpose of the clips. The present invention is described primarily in relation to such clips. However, it will be appreciated that it is generally applicable to many sheet metal articles in which a relatively functionally unimportant zone is provided for the purpose of spacing functional zones and to enable the article to be made and handled as a single piece.

An object of the present invention is to save materials in the manufacture of such articles by reducing the size of that part of the workpiece corresponding to the intermediate zone of the finished article.

With the above and other objects in mind, the present invention provides a method of making an expanded sheet metal work piece comprising the steps of:

(a) cutting and forming a blank for said workpiece;

(b) slitting an area of said work piece so as to define a non-functional zone of said work piece to render said non-functional zone extendable, said slitting defining a plurality of interconnected tongues extending in the longitudinal direction of said non-functional zone and in a direction at an angle to the longitudinal direction of said non-functional zone, each of said tongues having a route line;

(c) finally shaping said workpiece as required;

(d) subsequently extending said non-functional zone in said longitudinal direction by expansion to cause folding of said tongues about said route line so as to produce said expanded sheet metal work piece.

The invention extends to articles when made by the method of the invention.

The steps of slitting and subsequently extending the non-functional zone may be performed in a number of ways utilizing various slitting patterns and corresponding modes of extension. Furthermore, the extension of the zone may be effected either before or after the remainder of the workpiece has been shaped to conform to the required article.

The use of slitting a metal sheet and then expanding the sheet to form the end product is not new. In U.S. Pat. No. 1,195,221 of Herr there is disclosed a method of forming expanded sheet metal by providing a number of parallel, transverse slits in the metal and then expanding the metal to form the finished product. With this form of product, expansion of less than 100% can only be achieved. This is because there is a number of continuous and connected "paths" of metal, with the slits being expanded to form triangular or diamond-shaped openings. The structural strength of the expanded sheet metal is also relatively high. This contrasts with the present invention where expansion rates of well in excess of 100% are the norm. Expansion rates of up to 300% have been achieved. However, with the present invention there is a significant loss of inherent structural strength, but strength is of little concern in the clip of the invention.

Similar comments apply in relation to U.S. Pat. No. 3,111,204 of Phare; 3,740,812 of Ryan; 3,812,558 of Watanabe; and 3,962,763 of Jury. In all of these, the slitting of the sheet metal is generally in the one direction. This contrasts to the present invention where the slitting is in the longitudinal direction and in a direction at an angle to the longitudinal.

For U.S. Pat. No. 4,545,170 of Shirley arcuate slits are used and fold lines created. The metal is then folded back upon itself to create an expanded metal product. The expansion is limited to one fold and less than 100%. With the present invention, a plurality of twisted folds may be employed, and an expansion rate of at least 100% obtained. Expansion rates of up to 300% have been achieved.

By way of example, several embodiments of the above-described invention are described in more detail hereinafter with reference to the accompanying drawings, in which:

BRIEF DESCRIPTION OF THE DRAWINGS

FIGS. 3 and 4 are views similar to FIGS. 1 and 2 of expanded sheet metal articles or workpiece according to a second embodiment of the invention;

FIGS. 5 and 6 are views similar to FIGS. 1 and 2 of expanded sheet metal articles according to a third embodiment of the invention;

DESCRIPTION OF THE PREFERRED EMBODIMENTS

Figure 1:
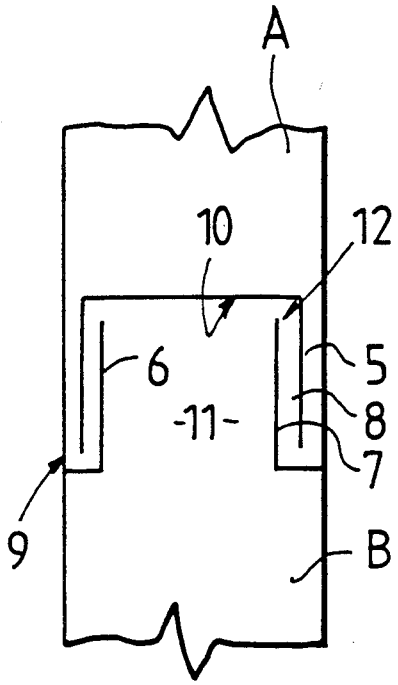
FIGS. 1 and 2 are diagrammatic partial plan views of an expanded sheet metal article or workpiece according to the invention at partly and fully finished stages of its production respectively.

In the drawings, the functionally shaped end zones A and B of the articles or workpieces, the specific details which form no part of the present invention, are merely shown in part because these would be used to create the clip end formations referred to earlier. In each instance the area between them constitutes an intermediate non-functional zone as that term is used herein.

It will be seen from FIG. 1 that the intermediate zone of the embodiment illustrated thereby has one U-shaped and two L-shaped slits 5, 6 and 7 cut in it. Those slits may be made simultaneously with the press-forming of the respective end zones A and B. It will be seen that the U-shaped slit 5 defines a first tongue 8 extending from a root line at 9 to a free tip 10, and in both a longitudinal direction as well as in a direction approximately 90° thereto.

The tongue 8 has formed in it a second narrower tongue 11 extending from a root line indicated at 12 to a free tip 13. The tip 13 of the tongue 11 is integral with the functional zone B of the article.

Figure 2:
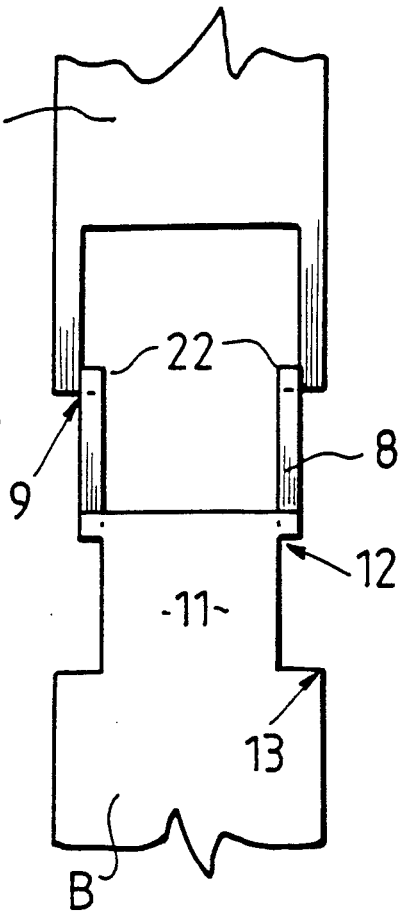

FIG. 2 shows the article in its finished or extended form, wherein tongue 8 has been folded in a clockwise direction about its root line 9 and tongue 11 has been folded 180° in an anti-clockwise direction about its root line 12, so that tongue 8 projects from the original intermediate zone and the narrower tongue 11 projects correspondingly from tongue 8.

The article of FIGS. 3 and 4 is a modification of that of FIGS. 1 and 2 in that the slit pattern applied to the whole of the intermediate zone of FIG. 1 is duplicated and applied to each half of a doubly long intermediate zone of FIG. 3. The patterns in each half zone are mirror images of each other and the narrower tongue of one half is integral with that of the other half instead of with a functional zone as in FIG. 2. The tongues of each half of the intermediate zone in FIGS. 3 and 4 have been given the same reference numerals as their counterparts in FIG. 1, but with a and b suffixes.

It is to be noted that at each junction 22 there is a fold of 180°. This is induced during the expansion process.

The article of FIGS. 5 and 6 is a further modification of that of FIGS. 1 and 2 in that the slit pattern applied to the intermediate zone of the former has been re-applied, with appropriate narrowing, to the narrower tongue to permit a second stage of extension. The reference numerals of FIGS. 5 and 6 again correspond to those of FIGS. 1 and 2 with appropriate suffixes. Again at each junction 22 there is a fold of 180° induced during the expansion process. It will be apparent also that in other similar embodiments this mode of slitting could be further replicated to produce three or more stages of extension of a single zone of the workpiece, with the only limit being the material width in the tongues 8,11; 8*a*,11*a*; 8*b*,11*b*; and so forth.

The articles illustrated and described above all belong to the said first class of embodiments whereas those described below all belong to the said second class of embodiments.

Figure 7:
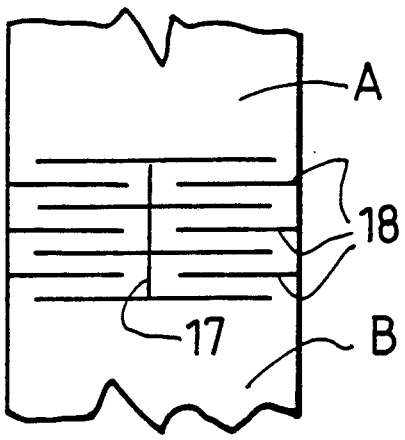
FIGS. 7 and 8 show fourth and fifth embodiments respectively.

The article illustrated by FIG. 7 is a modification of that of the earlier embodiments in that the intermediate zone is split longitudinally by slit 17 and each half is slit transversely approximately 90° to the longitudinal by a plurality of slits 18 similar to the end slit of FIG. 1. This allows the transverse slit pattern to be less complex than in the earlier embodiment. When pulled apart to expand the intermediate zone, the strips defined by the transverse slits 18 have been reoriented by 90°. This may be difficult to achieve in practice and a lesser degree of stretching may be used if preferred.

Figure 8:
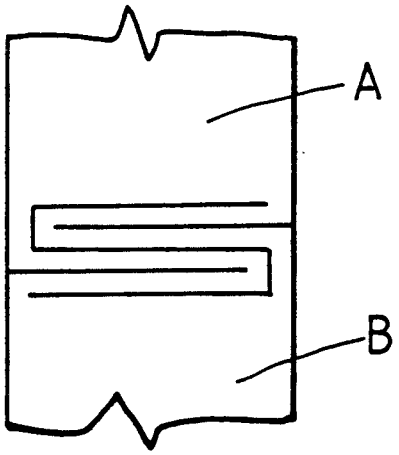

The article of FIG. 8 shows a further simplification of slit pattern. It is thought that in the light of the description generally, these figures will now be self explanatory and this embodiment needs no further description.

When the articles illustrated by FIGS. 7 and 8 are pulled apart, it may be preferred to follow the stretching step by a flattening of the expanded intermediate zone by, for example, pressing or rolling or the like, especially where a high degree of reorientation of the individual strips is resorted to.

Figure 9:
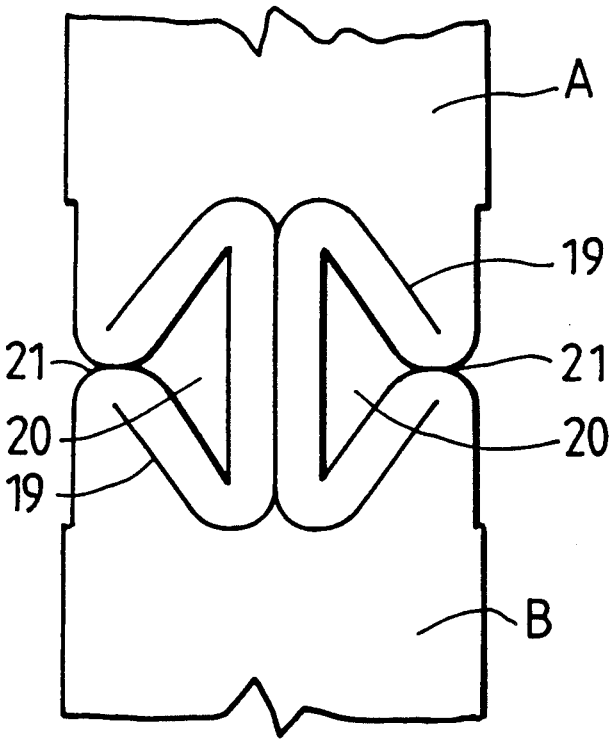
FIGS. 9 and 10 show a sixth embodiment of the invention.
Figure 10:
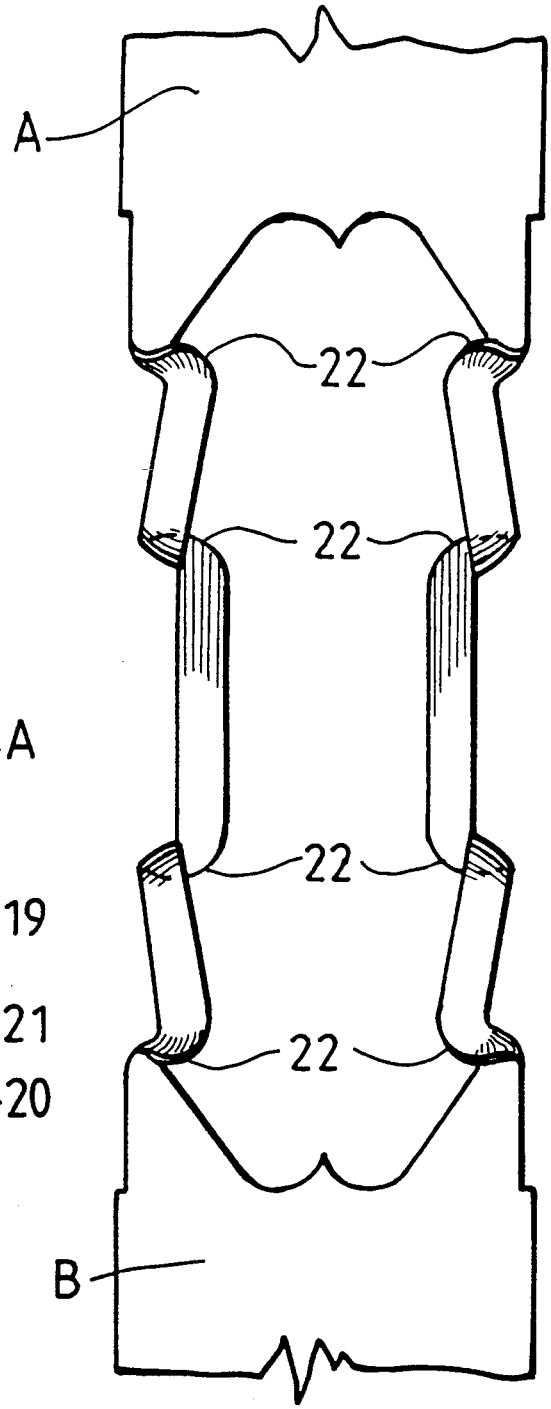

The article of FIGS. 9 and 10 uses slits 19 of approximately triangular configuration, some of which extend longitudinally and some of which may extend at an angle of about 45° to the longitudinal axis of the workpiece as shown in FIG. 9, together with a triangular cut-out 20, and arcuate slits 21. When pulled apart to expand the intermediate zone, the strips defined by the slits 19, cut-out 20 and slits 21 will have been reoriented, as is clearly shown in FIG. 10. Twisted folds of 180° are created at each junction 22. As for the articles of FIGS. 7 and 8 it may be preferred to follow the stretching step by flattening the expanded intermediate zone.

The illustrated embodiments of the invention described above all have two functional zones spaced apart by an intermediate non-functional zone extending from one functional zone to the other. It is emphasised however that the invention is not so limited. It may be that an article has three or more functional zones and a corresponding plurality of non-functional intermediate zones. In such instances each intermediate zone may be independently extended, not necessarily in a common direction.

In each embodiment illustrated, significant expansion can take place-up to 300% for the embodiment of FIGS. 5 and 6. Whenever there is a junction of two tongues, there will be a fold of 180°. Between the two sets of tongues after expansion there is no material, thus, in many instances, there is a considerable saving in material cost. The sets of tongues provide the necessary strength, and serve to retain the functional zones the required distance apart.

Furthermore, it may be that a functional zone has no direct relationship with another identifiable zone, it may simply require positioning with respect to the remainder of the article generally. In such instances a reduced area, appropriate misshapen workpiece may be made and subsequently a part thereof may be slit and extended in accordance with the invention to modify its shape and expand its area to suit the finished article.

To prevent unwanted propogation of the slits, a small round hole may be placed at the end thereof in accordance with standard engineering practice. This would also assist in the accurate locating of the junctions 22 as the holes would create a slight narrowing of the tongues and would thus locate where the twisting and/or folds were created.

I claim:

1. A method of making an expanded sheet metal workpiece comprising the steps of:

(a) slitting an area of a non-functional zone of said workpiece, thereby forming slits to render said non-functional zone extendable, said slits defining a plurality of interconnected tongues, each of said tongues extending in a longitudinal direction of said non-functional zone and in a direction at an angle to said longitudinal direction, each of said tongues having a root line, a major portion of said slits extending linearly with some of said slits extending in the longitudinal direction and some of said slits extending at an angle to said longitudinal direction, at least some of the longitudinally and angularly extending slits being interconnected with each other;

(b) subsequently extending said non-functional zone in said longitudinal direction by expansion of the non-functional zone by at least 100%, said expansion causing folding of said tongues about said root line, thereby producing said expanded sheet metal workpiece.

2. A method as claimed in claim 1, wherein said expanded sheet metal workpiece includes two functional zones, one at each end of said non-functional zone.

3. A method as claimed in claim 1, wherein said non-functional zone prior to said slitting of said area and said extending, is shorter than the non-functional zone subsequent to said slitting and said extending.

4. A method as claimed in claim 1, further comprising flattening said non-functional zone subsequent to said slitting and said extending.

5. A method as claimed in claim 1, wherein said angle is approximately 45°.

6. The method as claimed in claim 5, wherein said expansion causes twisting and folding of said tongues about said root line, thereby producing said expanded metal workpiece.

7. A method as claimed in claim 1, wherein said angle is approximately 90°.

8. The method as claimed in claim 1, wherein said expansion causes twisting and folding of said tongues about said root line, thereby producing said expanded metal workpiece.

* * * * *